US006962062B2

(12) United States Patent
Ha et al.

(10) Patent No.: US 6,962,062 B2
(45) Date of Patent: Nov. 8, 2005

(54) PROCESS AND APPARATUS FOR THE SEPARATION OF AIR BY CRYOGENIC DISTILLATION

(75) Inventors: Bao Ha, San Ramon, CA (US); Jean-Renaud Brugerollle, Paris (FR)

(73) Assignee: L'Air Liquide, Société Anonyme à Directoire et Conseil de Surveillance pour l'Etude et l'Exploitation des Proédés Georges Claude, Paris (FR)

( * ) Notice: Subject to any disclaimer, the term of this patent is extended or adjusted under 35 U.S.C. 154(b) by 11 days.

(21) Appl. No.: 10/732,673

(22) Filed: Dec. 10, 2003

(65) Prior Publication Data

US 2005/0126221 A1 Jun. 16, 2005

(51) Int. Cl.[7] ..... F25J 3/00
(52) U.S. Cl. ..... 62/654; 62/647
(58) Field of Search ..... 62/654, 644, 647, 62/643

(56) References Cited

U.S. PATENT DOCUMENTS 4,560,398 A * 12/1985 Beddome et al. ..... 62/646
5,379,598 A * 1/1995 Mostello ..... 62/646
5,475,980 A 12/1995 Grenier et al.
5,511,381 A * 4/1996 Higginbotham ..... 62/646
5,533,339 A * 7/1996 Clare et al. ..... 62/654
5,596,885 A 1/1997 Grenier
5,887,447 A * 3/1999 Higginbotham ..... 62/643
5,901,576 A 5/1999 Agrawal et al.
6,626,008 B1 9/2003 Prosser et al.
6,779,361 B1 * 8/2004 Skare et al. ..... 62/643

FOREIGN PATENT DOCUMENTS

EP 0 644 388 3/1995
EP 0 932 000 7/1999

OTHER PUBLICATIONS

International Search Report for PCT/IB2004/003925.

* cited by examiner

*Primary Examiner*—William C. Doerrler
(74) *Attorney, Agent, or Firm*—Linda K. Russell

(57) ABSTRACT

A method for separating air by cryogenic distillation. A first compressor compresses air to a first pressure, and sends part of that air to a second compressor which compresses that part to a second pressure. Part of the air at the second pressure is cooled in a heat exchanger and sent to a third compressor where part of it is compressed to a third pressure. Part of the air at the third pressure is liquefied and sent a column system. Around half of the total liquefied air sent to the column system will have originally been compressed by the third compressor. Part of the air at the first pressure is cooled in a heat exchanger and part of the cooled air at the first pressure is then expanded to the pressure of the column system. The expanded air is sent to the column system.

11 Claims, 8 Drawing Sheets

PROCESS AND APPARATUS FOR THE SEPARATION OF AIR BY CRYOGENIC DISTILLATION

TECHNICAL FIELD

The present invention relates to a process and apparatus for the separation of air by cryogenic distillation. It relates in particular to processes and apparatus for producing oxygen and/or nitrogen at elevated pressure.

This invention is an improvement of the inventions presented in French patent applications n°03 50141 filed on May 5, 2003 and n°03 50142 filed on May 5, 2003.

BACKGROUND ART

Gaseous oxygen produced by air separation plants are usually at elevated pressure about 20 to 50 bar. The basic distillation scheme is usually a double column process producing oxygen at the bottom of the low pressure column operated at 1.4 to 4 bar. The oxygen must be compressed to higher pressure either by oxygen compressor or by the liquid pumped process. Because of the safety issues associated with the oxygen compressors, most recent oxygen plants are based on the liquid pumped process. In order to vaporize liquid oxygen at elevated pressure there is a need for an additional motor-driven booster compressor to raise a portion of the feed air or nitrogen to higher pressure in the range of 40–80 bars. In essence, the booster replaces the oxygen compressor.

In the effort to reduce the complexity of an oxygen plant, it is desirable to reduce the number of motor-driven compressors. Significant cost reduction can be achieved if the booster can be eliminated without much affecting the plant performance in terms of power consumption. Furthermore, the air purification unit conceived for a traditional oxygen plant would operate at about 5–7 bar which is essentially the pressure of the high pressure column, and it is also desirable to raise this pressure to a higher level in order to render the equipment more compact and less costly.

A cold compression process as described in U.S. Pat. No. 5,475,980 provides a technique to drive the oxygen plant with a single air compressor. In this process air to be distilled is chilled in the main exchanger then further compressed by a booster compressor driven by an expander exhausting into the high pressure column of a double column process. By doing so, the discharge pressure of the air compressor is in the range of 15 bar which is also quite advantageous for the purification unit. One inconvenience of this approach is the increase of the size of the main exchanger due to additional flow recycling which is typical for the cold compression plant. One can reduce the size of the exchanger by opening up the temperature approaches of the exchanger. However, this would lead to inefficient power usage and higher discharge pressure of the compressor and therefore increasing its cost. An illustration of this prior art is presented in FIG. 1, in which an oil brake is added to the system to dissipate the power required for the refrigeration. In larger plants, an expander can replace the oil brake.

Figure 1:
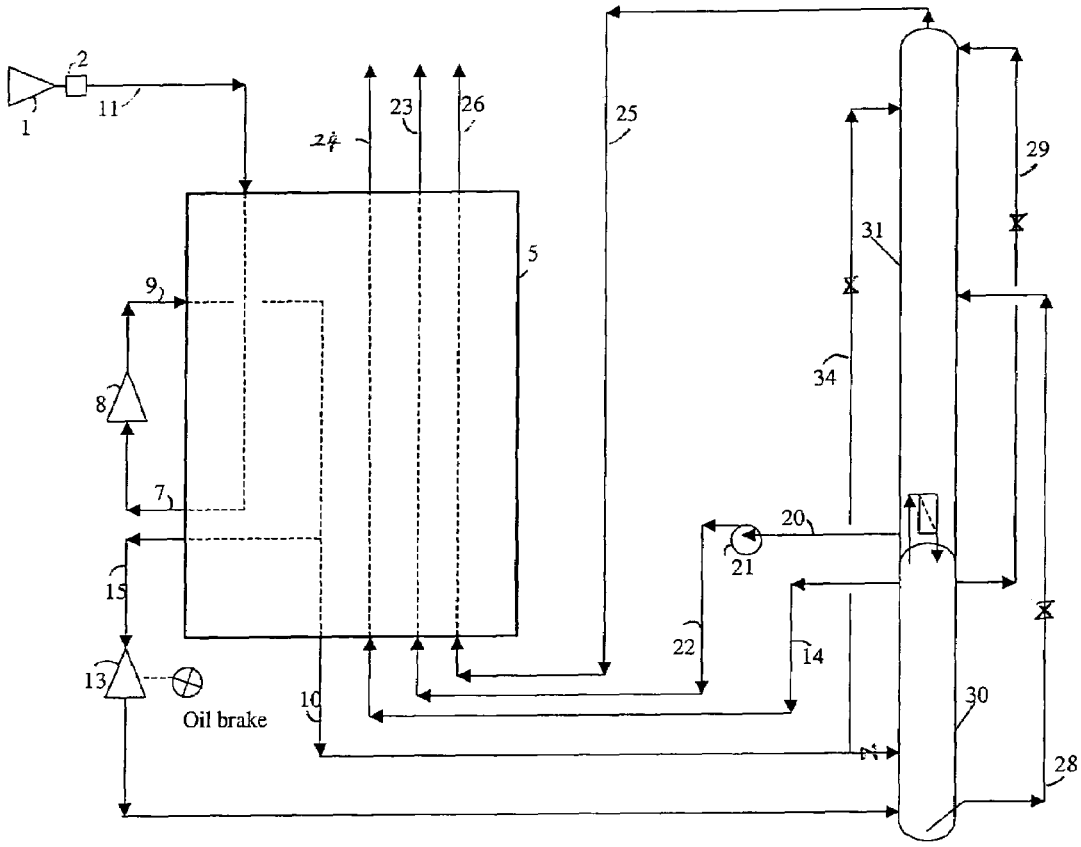
Prior art Figure 1

In FIG. 1 all the feed air is compressed in compressor 1, purified in purification unit 2 and sent as stream 11 to the warm end of the heat exchanger 5. All the feed air is cooled to an intermediate temperature, removed from the heat exchanger as stream 7 and compressed in cold compressor 8. The compressed stream 9 is sent back to the heat exchanger at a higher intermediate temperature, cooled to a temperature lower than the inlet temperature of the cold compressor 8 and divided in two. Stream 15 is sent to the Claude expander 13 which is braked by the compressor 8 and an oil brake. The rest of the air 10 is liquefied in the heat exchanger and divided into two parts, one part being sent to the high pressure column 30 and the rest 34 being sent to the low pressure column 31.

An oxygen enriched liquid stream 28 is expanded and sent from the high pressure column to the low pressure column. A nitrogen enriched liquid stream 29 is expanded and sent from the high pressure column to the low pressure column. High pressure gaseous nitrogen 14 is removed from the top of the high pressure column and warmed in the heat exchanger to form a product stream 24. Liquid oxygen 20 is removed from the bottom of the low pressure column 31, pressurized by a pump 21 and sent as stream 22 to the heat exchanger 5 where it vaporizes by heat exchange with the pressurized air 10 to form gaseous pressurized oxygen 23. A top nitrogen enriched gaseous stream 25 is removed from the low pressure column 31, warmed in the heat exchanger 5 and then forms stream 26.

Some different versions of the cold compression process were also described in prior art as in U.S. Pat. Nos. 5,379,598, 5,596,885, 5,901,576 and 6,626,008.

In U.S. Pat. No. 5,379,598 a fraction of feed air is further compressed by a booster compressor followed by a cold compressor to yield a pressurized stream needed for the vaporization of oxygen. This approach still has at least two compressors and the purification unit still operates at low pressure.

In U.S. Pat. No. 5,596,885, a fraction of the feed air is further compressed in a warm booster whilst at least part of the air is further compressed in a cold booster. Air from both boosters is liquefied and part of the cold compressed air is expanded in a Claude expander.

U.S. Pat. No. 5,901,576 describes several arrangements of cold compression schemes utilizing the expansion of vaporized rich liquid of the bottom of the high pressure column, or the expansion of high pressure nitrogen to drive the cold compressor. In some cases, motor driven cold compressors were also used. These processes also operate with feed air at about the high pressure column's pressure and in most cases a booster compressor is also needed.

U.S. Pat. No. 6,626,008 describes a heat pump cycle utilizing a cold compressor to improve the distillation process for the production of low purity oxygen for a double vaporizer oxygen process. Low air pressure and a booster compressor are also typical for this kind of process.

Therefore it is a purpose of this invention to resolve the inconveniences of the traditional process by providing a solution to simplify the compression train and to reduce the size of the purification unit. This can moreover be achieved with good power consumption. The overall product cost of an oxygen plant can therefore be reduced.

SUMMARY OF THE INVENTION

According to the present invention, there is provided a process for separating air by cryogenic distillation in a column system comprising a high pressure column and a low pressure column comprising the steps of:

i) compressing all the feed air in a first compressor to a first outlet pressure ii) sending a first part of the air at the first outlet pressure to a second compressor and compressing the air to a second outlet pressure iii) cooling at least part of the air at the second outlet pressure in a heat exchanger to form cooled compressed air at the second outlet pressure, sending at least part of the cooled compressed air at the second outlet pressure to a third compressor and compressing the at least part of the cooled compressed air at the second outlet pressure to a third outlet pressure iv) liquefying at least part of the air at the third outlet pressure and sending the liquefied air to at least one column of the column system wherein at least 50%, preferably at least 60%, more preferably at least 70% of the liquefied air sent to the column system has been compressed in the third compressor v) cooling a second part of the air at the first outlet pressure in the heat exchanger and expanding at least part of the second part of the air in an expander from the first outlet pressure to the pressure of a column of column system and sending the expanded air to that column vi) removing liquid from a column of the column system, pressurizing the liquid and vaporizing the liquid by heat exchange in the heat exchanger.

According to optional features of the invention:

at least part of the first part of the air is cooled upstream of the second compressor.

at least part of the first part of the air is cooled upstream of the second compressor in the heat exchanger.

at least part of the first part of the air is cooled upstream of the second compressor in the heat exchanger using a refrigeration unit.

additional air is liquefied in the heat exchanger at at least one of the first and second pressures.

the third compressor compresses only air to be liquefied.

According to another aspect of the invention, there is provided an apparatus for the separation of air by cryogenic distillation comprising:

a) a column system b) first, second and third compressors c) an expander d) a conduit for sending air to the first compressor to form compressed air at a first outlet pressure e) a conduit for sending a first part of the air at the first outlet pressure to the second compressor to form air at a second outlet pressure f) a heat exchanger, a conduit for sending at least part of the air at the second outlet pressure to the heat exchanger to form cooled compressed air at the second outlet pressure, g) a conduit for sending at least part of the cooled compressed air at the second outlet pressure to the third compressor to produce air at a third outlet pressure h) a conduit for removing liquefied air at the third outlet pressure from the heat exchanger and for sending the liquefied air to at least one column of the column system wherein at least 50% of the liquefied air sent to the column system has been compressed in the third compressor i) a conduit for removing a second part of the air at the first outlet pressure from the heat exchanger and for sending at least part of the second part of the air to the expander j) a conduit for sending air expanded in the expander to at least one column of column system k) a conduit for removing liquid from a column of the column system, means for pressurizing at least part of the liquid to form pressurized liquid and a conduit for sending at least part of the pressurized liquid to the heat exchanger.

According to further optional aspects of the invention, the apparatus may include a further expander and means for sending nitrogen from a column of the column system or air to the further expander.

In this case, one of the second and third compressors may be coupled to the expander and the other of the second and third compressors may be coupled to the further expander.

At least one of the second and third compressors is coupled to the air expander.

Preferably the conduit for sending a first part of the air at the first outlet pressure to the second compressor is connected to an intermediate point of the heat exchanger.

Preferably the second and third compressors are connected in series.

The expander may be chosen from the group including an air expander whose outlet is connected to the high pressure column, an air expander whose outlet is connected to the low pressure column, a high pressure nitrogen expander and a low pressure nitrogen expander.

The apparatus may include a further expander chosen from the group including an air expander whose outlet is connected to the high pressure column, an air expander whose outlet is connected to the low pressure column, a high pressure nitrogen expander and a low pressure nitrogen expander.

Preferably the further expander is coupled to one of the second and third expanders.

DETAILED DESCRIPTION OF THE INVENTION

Figure 7:
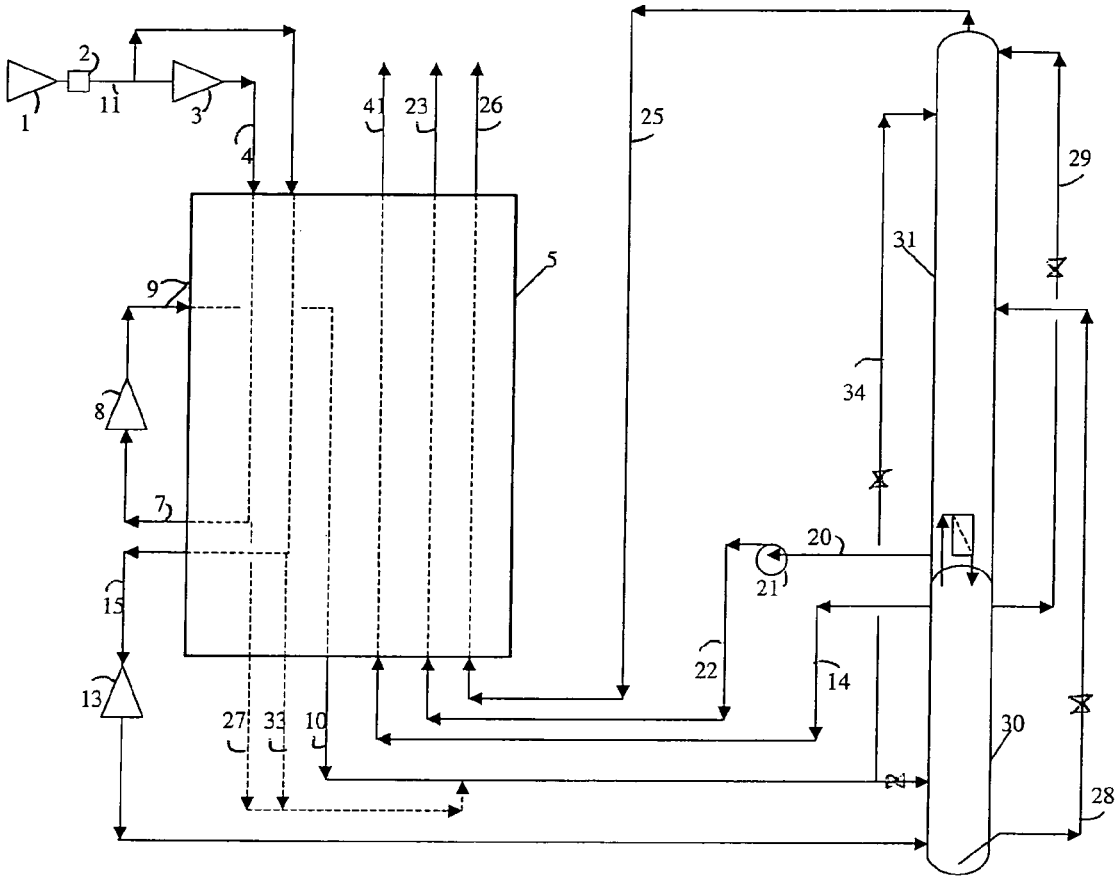
Figure 8:
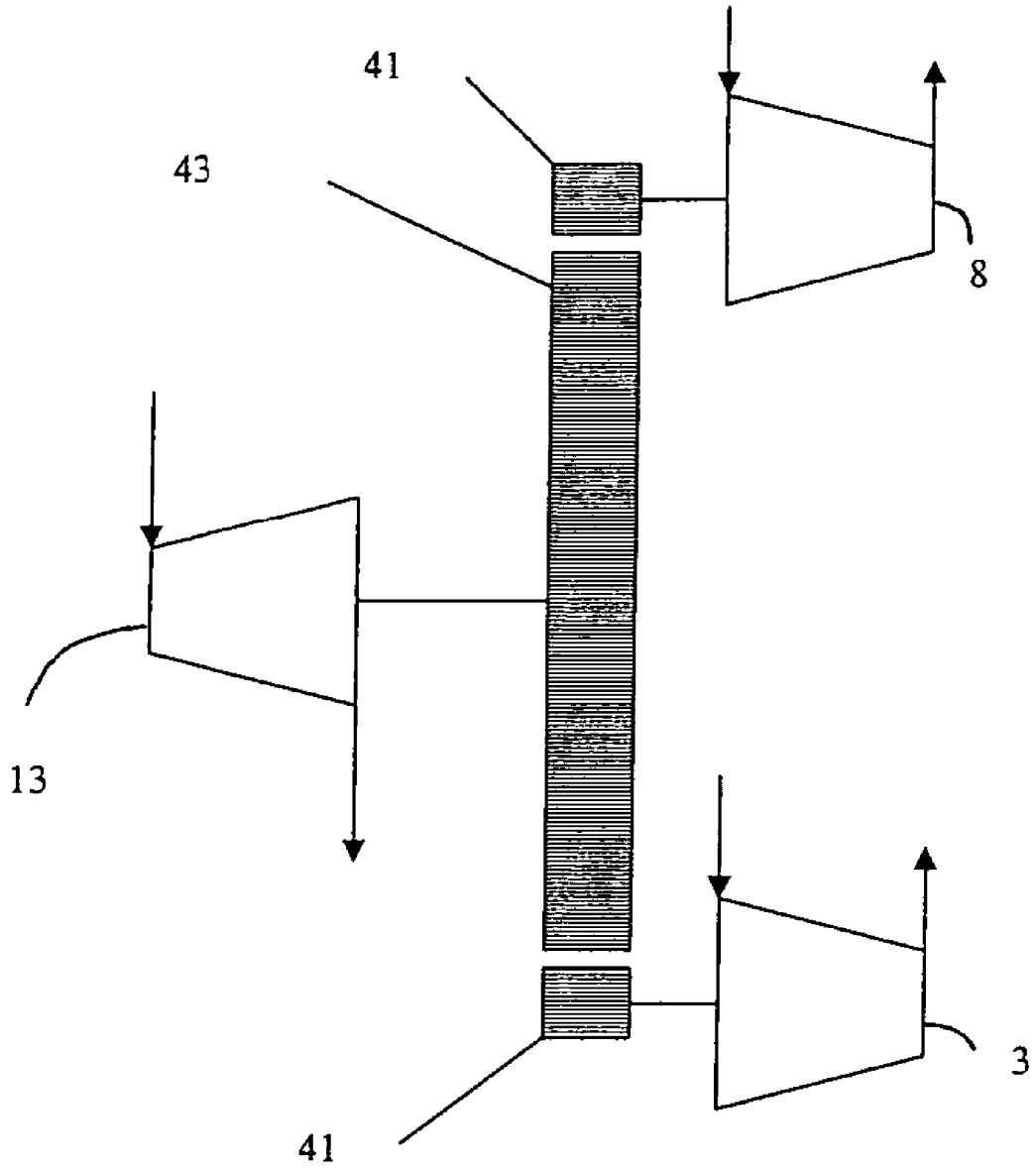

The invention will now be described in greater detail with reference to FIGS. 2 to 7 which are process flow diagrams representing cryogenic air separation processes according to the invention and to FIG. 8 which shows a coupling system for compressors and expanders in a process according to the invention.

Figure 2:
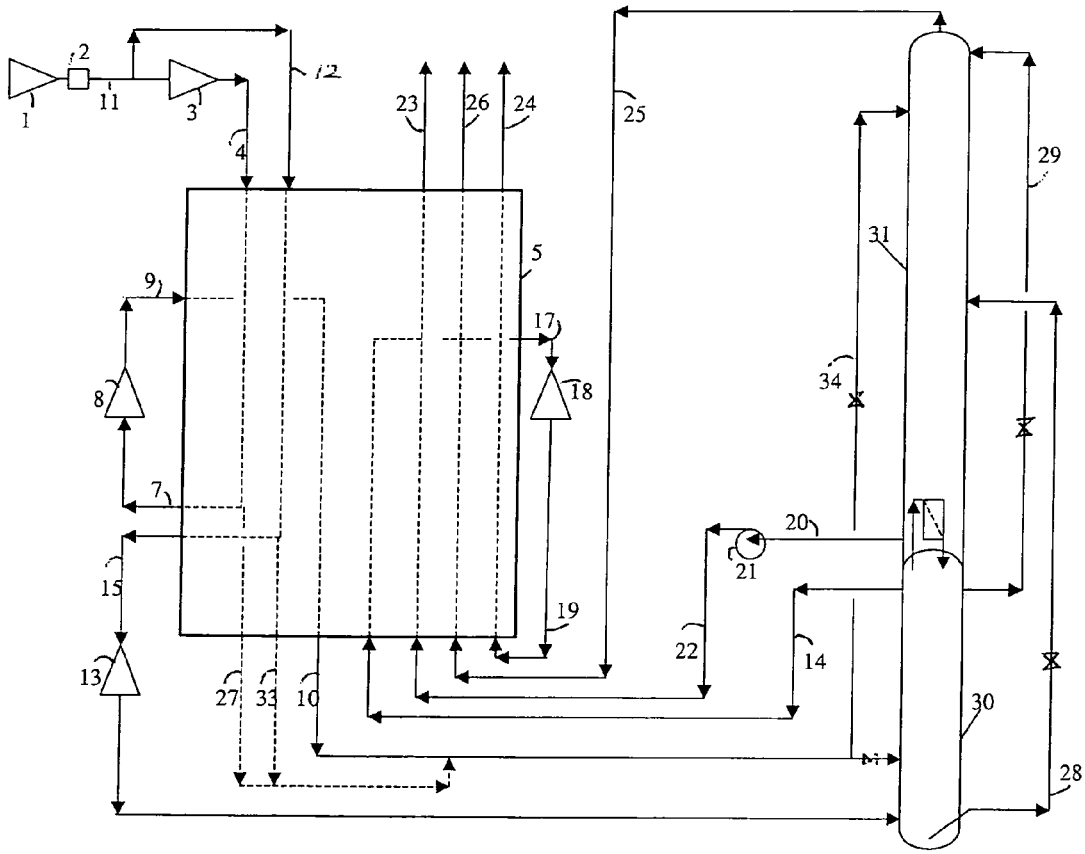

In the embodiment of FIG. 2, atmospheric air is compressed by the air compressor 1 and purified in the purification unit 2 to yield an air stream (stream 11) free of impurities such as moisture and carbon dioxide that can freeze in the cryogenic equipment. A first portion of this air is compressed in a booster brake compressor 3 to raise its pressure further. This pressurized first portion (stream 4) is then cooled in the main exchanger 5 to an intermediate temperature T1 of the main exchanger to yield a cold air stream. At least a portion of this cold air (stream 7) is sent to a cold booster brake compressor 8 to be compressed to raise its pressure even more (stream 9). Stream 9 is then sent back to the exchanger at temperature T2 which is greater than T1 and is cooled in exchanger 5 to condense to form a liquefied air stream (stream 10), which is fed to at least one of the distillation columns, following expansion in a valve. The air may liquefy within or downstream the main exchanger depending on the pressure used. The second portion of stream 11 (stream 12) is cooled in exchanger 5 to yield stream 15, which is sent to the expander 13 at an inlet temperature of T3, less than T1, for expansion into the high pressure column. It is preferable that the power generated by expander 13 be used to drive the booster brake compressor 3. Nitrogen rich gas 14 can be extracted from the high pressure column 30, warmed in exchanger 5 to form stream 17, which is then expanded in expander 18 having an inlet temperature T5. The power of expander 18 can be preferably used to drive the cold booster brake compressor 8. The exhaust of expander 18 (stream 19) then returns to the cold end of exchanger 5 to be re-heated to close to ambient temperature forming stream 24. Pump 21 boosts the pressure of liquid oxygen product 20 extracted at the bottom of the low pressure column 31 to the desired pressure then sends pressurized oxygen stream 22 to exchanger 5 for vaporization and heating to yield the oxygen product 23. The double column system is a traditional type of two-column process as described in numerous patents or papers for air separation technology having a high pressure column 30 and a low pressure column 31, thermally linked by a reboiler-condenser at the bottom of the low pressure column. An argon column (not shown) can be used with the double column system to provide a concentrated argon stream.

The above temperatures T1, T2, T3, T4 and T5 are provided as the preferred arrangement. Depending upon the pressure of the vaporized oxygen and the pressure of the column system the order of these temperatures can be modified to optimize the performance of the process.

It is useful to note the booster brake compressors 3,8 are single stage compressors and are usually provided as part of the expander-booster packages and therefore their construction is much simpler and their cost structures are much lower than the stand-alone or motor-driven booster compressor. However if necessary, compressors 3 or 8 may be stand-alone or motor-driven booster compressors.

The range of the process variables of the embodiment of FIG. 2 is as follows:

Stream 11 pressure: about 11 to 17 bar a

Stream 4 pressure: about 18 to 25 bar a

Stream 9 pressure: about 27 to 50 bar a

T1: about −110° C. to −140° C.

The flow compressed by the booster brake compressor 8 can be reduced by optionally extracting some liquefied air flows via streams 27 or/and 33. As such, less power is required to drive the booster brake compressor 8 and some power savings can be achieved. The amount of air liquefied at the first and second pressures should not be more than 50% of the liquefied air sent to the column system, preferably not more than 40%, more preferably not more than 35%. The flow compressed by the booster brake compressor 8 represents at least 10% of the feed air, preferably between 15 and 30% of the feed air.

Figure 3:
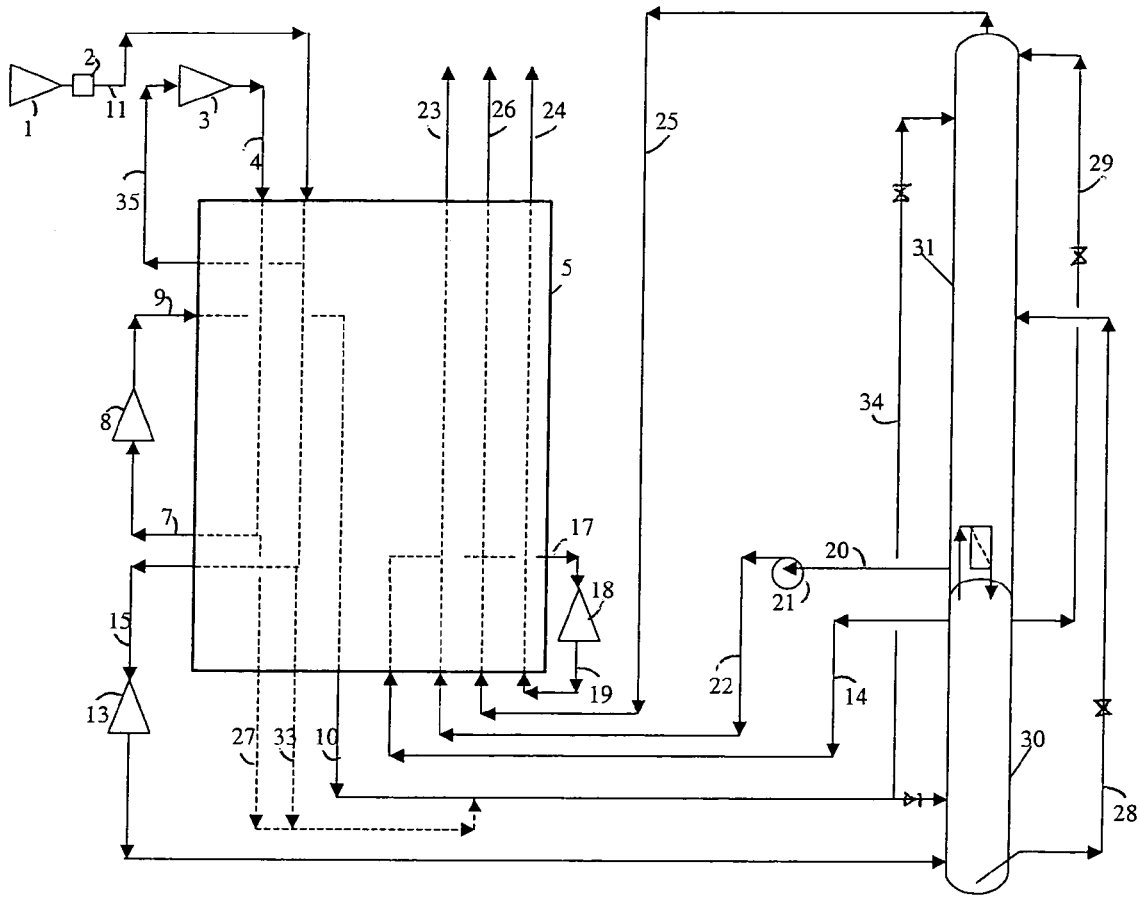

In this scheme of FIG. 3, all of the stream 11 is sent to the heat exchanger 5 and is divided after preliminary cooling to temperature T6 between about −20° C.– 0° C., greater than T2. Part 35 of the air is sent to the inlet of the booster brake compressor 3. This improves the performance of this booster brake compressor 3 and results in a higher discharge pressure. The after-cooler heat exchanger of compressor 3 (not shown) may also be eliminated to reduce the pressure drop and to lower the equipment cost. The rest of the air is sent to expander 13 or divided in two, one part being sent to expander 13 and the rest 33 being liquefied, as previously described.

The rest of FIG. 3 is as described in FIG. 2.

Figure 4:
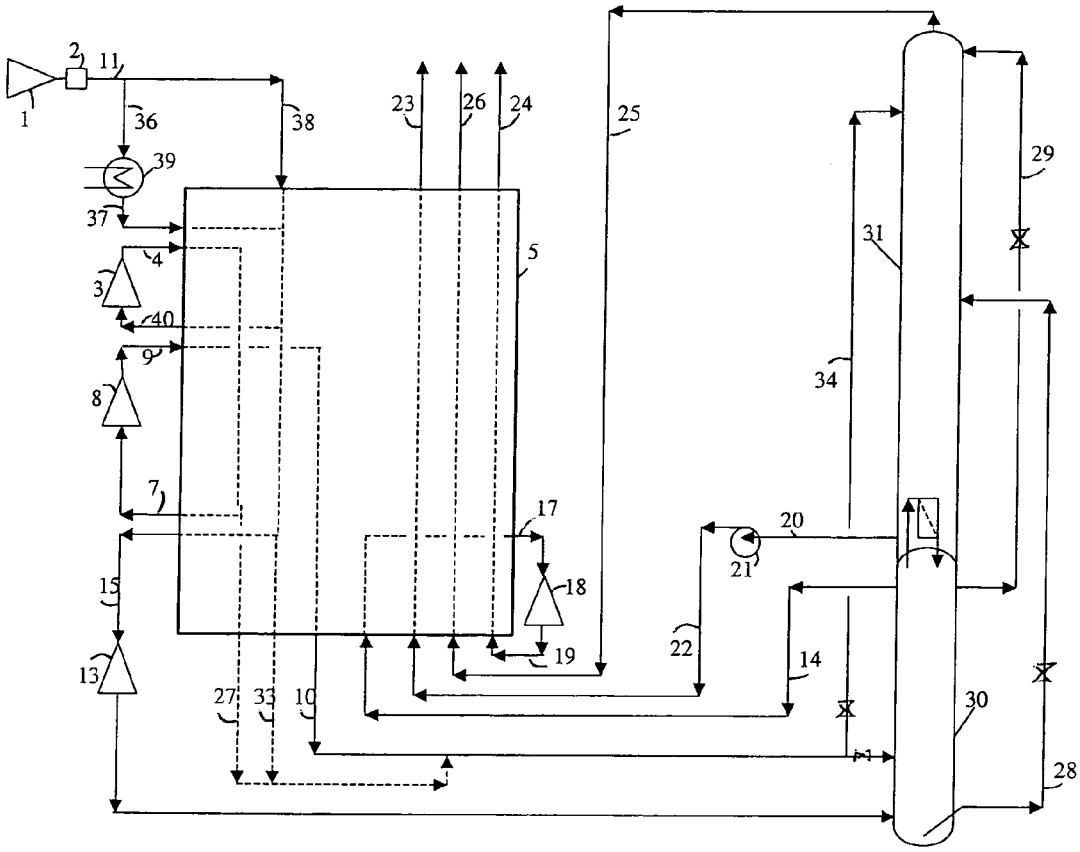
Figure 5:
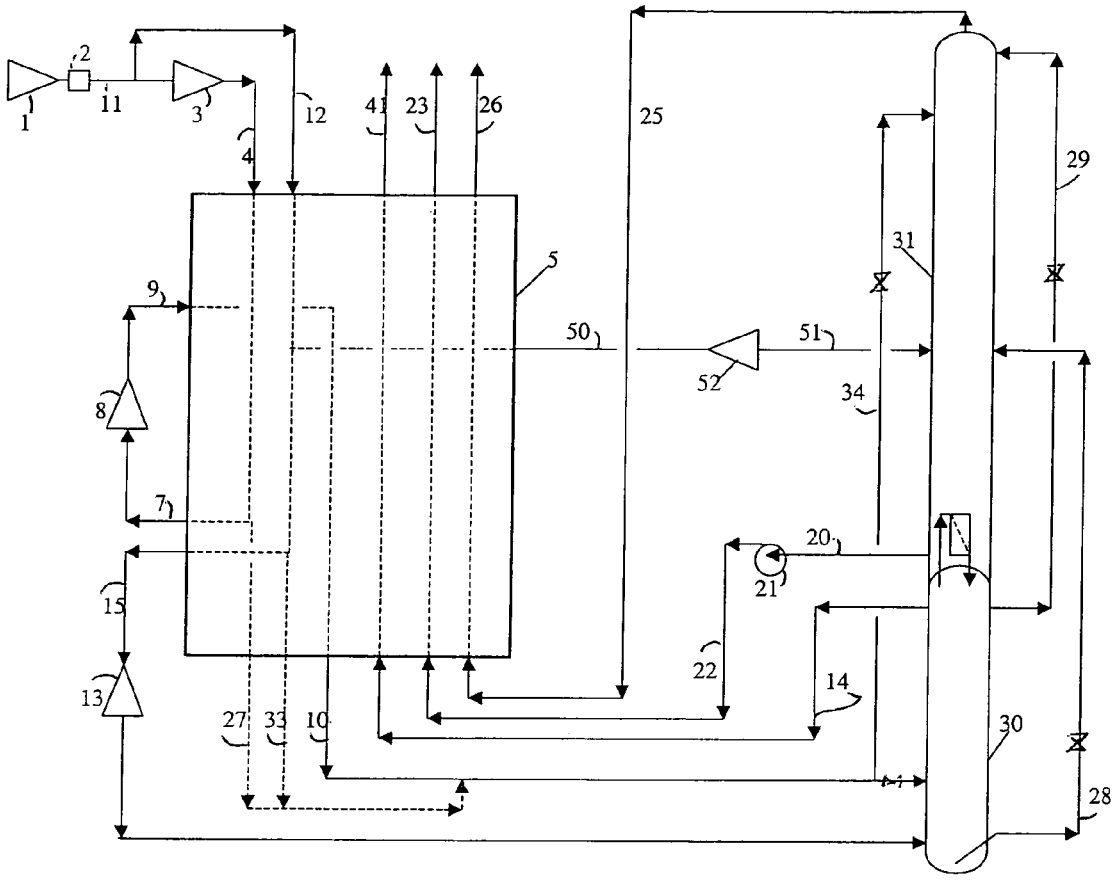

In the embodiment of FIG. 4, by adding a mechanical refrigeration unit 39 (using Freon™ or some other refrigerants) one can further improve the performance of the embodiment of FIG. 3 by lowering the inlet temperature T6 of the booster brake compressor 8 to about −90° C. to −50° C. The discharge pressure of the compressor 1 can be lowered to facilitate the compressor selection and to improve the power consumption of the process. The refrigeration unit 39 would operate at a temperature level of about −50° C. to −20° C. The additional power requirement of the refrigeration equipment is small compared with the overall reduction of the power consumption.

The stream 11 compressed in compressor 1 is divided upstream of the heat exchanger 5, one part 38 being sent directly to the heat exchanger without any intermediate cooling and the rest 36 being cooled using refrigeration unit 39 to form stream 37. Stream 37 is sent to an intermediate point of the heat exchanger 5 and joins partially cooled stream 38.

It is common practice in air separation technology to substitute the nitrogen expander with an air expander. The embodiment of FIG. 5 describes such an arrangement: after the first compressor, the portion 12 of stream 11 is cooled in exchanger 5 and part of this stream is extracted to yield stream 50, which is sent to expander 52 for expansion into the low pressure column 31. The power of expander 52 is preferably used to drive the cold compressor 8. It is useful to note that one can also opt to divide stream 12 before exchanger 5 and send the corresponding air stream to a separate passage in exchanger 5 then cool and expand it in expander 52 into the column.

Figure 6:
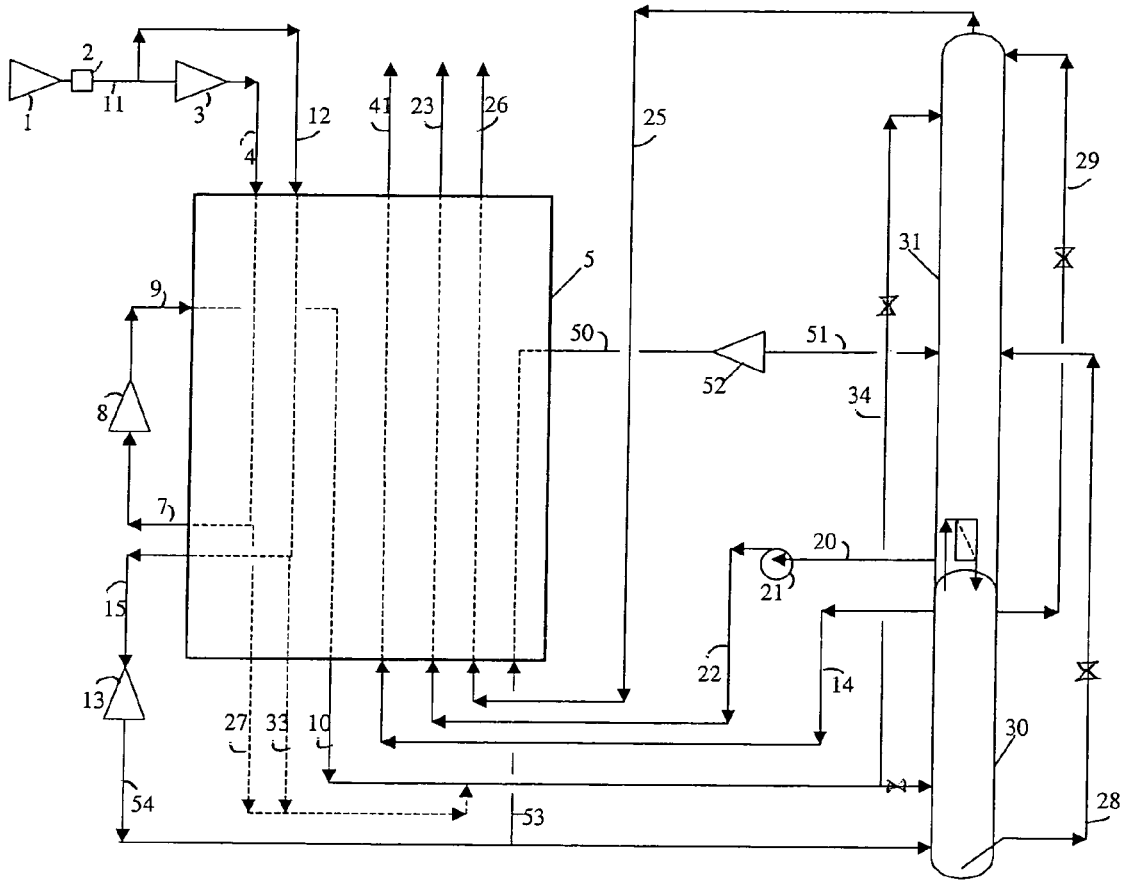

The above technique can be modified slightly as described in FIG. 6: a portion 53 of the air at the exhaust stream 54 of expander 13 can be warm in the exchanger 5 then send to the expander 52 for expansion into the low pressure column. In situations where there is some condensation in stream 54, one can extract the gas feeding the expander 52 by adding a vapor-liquid separator or even better, use the sump of the high pressure column as a separator, in this case, the gas feeding the expander is extracted at the sump of the high pressure column.

In many situations where there is a need for a significant amount of nitrogen rich gas product at elevated pressure, it is no longer economical to utilize the nitrogen rich gas expander 18. Instead as shown in FIG. 7 the nitrogen rich gas 14 can be extracted and produced directly off the high pressure column 30 to yield the nitrogen product 41. In those situations one can opt to raise the pressure of compressor 1 to increase the power output of the expander 13 to cover the lack of refrigeration caused by the elimination of the nitrogen expander. To further simplify the expander and booster brake compressors arrangement, the tandem expander and booster brakes can be mechanically integrated into a single train: the power of the expander 13 drives the two compressor brakes 3 and 8. Depending upon the flows and pressures of the expander and booster brake compressors a speed changer (gear) can be used to optimize the system performance. An illustration of the arrangement with gear is presented in FIG. 8.

The process may be modified to vaporize pumped liquid nitrogen as an additional stream or as a stream replacing the pumped oxygen stream.

The illustrated processes show double column systems but it will be readily understood that the invention applies to triple column systems.

In the case where the double or triple column systems operate at elevated pressures, some of the low pressure nitrogen may be expanded in an expander 18.

Although the invention has been described in detail with reference to certain preferred embodiments, those skilled in the art will recognize that there are other embodiments of the invention within the spirit and scope of the claims.

What is claimed is:

1. A process for separating air by cryogenic distillation in a column system comprising a high pressure column and a low pressure column comprising the steps of:

i. compressing all the feed air in a first compressor to a first outlet pressure, ii. sending a first part of the air at the first outlet pressure to a second compressor and compressing the air to a second outlet pressure, iii. cooling at least part of the air at the second outlet pressure in a heat exchanger to form cooled compressed air at the second outlet pressure, sending at least part of the cooled compressed air at the second outlet pressure to a third compressor and compressing the at least part of the cooled compressed air at the second outlet pressure to a third outlet pressure, iv. liquefying at least part of the air at the third outlet pressure and sending the liquefied air to at least one column of the column system wherein at least 50% of all liquefied air sent to the column system has been compressed in the third compressor, v. cooling a second part of the air at the first outlet pressure in the heat exchanger and expanding at least part of the second part of the air in an expander from the first outlet pressure to the pressure of a column of column system and sending the expanded air to that column, and vi. removing liquid from a column of the column system, pressurizing the liquid and vaporizing the liquid by heat exchange in the heat exchanger, and wherein:

i. at least part of the first part of the air is cooled upstream of the second compressor, and ii. at least part of the first part of the air is cooled upstream of the second compressor in the heat exchanger.

2. The process of claim 1 wherein at least part of the first part of the air is cooled upstream of the second compressor in the heat exchanger using a refrigeration unit.

3. The process of claim 1 wherein additional air is liquefied in the heat exchanger at least one of the first and second pressures.

4. The process of claim 1 wherein the third compressor compresses only air to be liquefied.

5. An apparatus for the separation of air by cryogenic distillation comprising:

a) a column system, b) first, second and third compressors, c) an expander, d) a conduit for sending air to the first compressor to form compressed air at a first outlet pressure, e) a conduit for sending a first part of the air at the first outlet pressure to the second compressor to form air at a second outlet pressure, f) a heat exchanger, wherein the conduit for sending a first part of the air at the first outlet pressure to the second compressor is connected to an intermediate point of the heat exchanger, g) a conduit for sending at least part of the air at the second outlet pressure to the heat exchanger to form cooled compressed air at the second outlet pressure, h) a conduit for sending at least part of the cooled compressed air at the second outlet pressure to the third compressor to produce air at a third outlet pressure, i) a conduit for sending at least part of the air at the third outlet pressure to the heat exchanger to form liquefied air at the third outlet pressure, j) a conduit for removing liquefied air at the third outlet pressure from the heat exchanger and for sending the liquefied air to at least one column of the column system wherein at least 50% of the liquefied air sent to the column system has been compressed in the third compressor, k) a conduit for removing a second part of the air at the first outlet pressure from the heat exchanger and for sending at least part of the second part of the air to the expander conduit for sending air expanded in the expander to at least one column of column system, and l) a conduit for removing liquid from a column of the column system, means for pressurizing at least part of the liquid to form pressurized liquid and a conduit for sending at least part of the pressurized liquid to the heat exchanger.

6. The apparatus of claim 5 including a further expander and means for sending nitrogen from a column of the column system to the further expander.

7. The apparatus of claim 6 wherein one of the second and third compressors is coupled to the expander and the other of the second and third compressors is coupled to the further expander.

8. The apparatus of claim 5 wherein at least one of the second and third compressors is coupled to the expander.

9. The apparatus of claim 5 wherein the expander is chosen from the group including an air expander whose outlet is connected to the high pressure column, an air expander whose outlet is connected to the low pressure column, a high pressure nitrogen expander and a low pressure nitrogen expander.

10. The apparatus of claim 5 including a further expander chosen from the group including an air expander whose outlet is connected to the high pressure column, an air expander whose outlet is connected to the low pressure column, a high pressure nitrogen expander and a low pressure nitrogen expander.

11. The apparatus of claim 10 wherein the further expander is coupled to one of a second and a third expanders.

* * * * *